US006158550A

United States Patent [19]

Arnoldy

[11] Patent Number: 6,158,550

[45] **Date of Patent: *Dec. 12, 2000**

[54] SAFETY GUARD FOR SCISSOR LIFT

[76] Inventor: Richard L. Arnoldy, 808 Jack St., Rothschild, Wis. 54474

[ * ] Notice: This patent issued on a continued prosecution application filed under 37 CFR 1.53(d), and is subject to the twenty year patent term provisions of 35 U.S.C. 154(a)(2).

[21] Appl. No.: 09/056,438

[22] Filed: Apr. 7, 1998

Related U.S. Application Data

[60] Provisional application No. 60/043,662, Apr. 11, 1997.

[51] Int. Cl.[7] ..... E04B 1/20

[52] U.S. Cl. ..... 182/69.5; 182/129

[58] Field of Search ..... 182/69.3, 129; D3/1–3; 416/72, 73; 211/134

[56] References Cited

U.S. PATENT DOCUMENTS 1,675,909 7/1928 Riker .
2,153,508 4/1939 Marchbank .
2,560,762 7/1951 Ghegan .
2,625,443 1/1953 Sensenbaugh .
3,319,697 5/1967 Krohn .
3,754,786 8/1973 Boucher et al. .
4,040,142 8/1977 Ippolito .
4,175,644 11/1979 Sikli .
4,878,267 11/1989 Roach et al. .
5,046,990 9/1991 Mikesha et al. .
5,261,681 11/1993 Goldmeier .
5,390,760 2/1995 Murphy .

*Primary Examiner*—Alvin Chin-Shue
*Attorney, Agent, or Firm*—Merchant & Gould P.C.

[57] ABSTRACT

An expandable safety guard for a scissor lift is disclosed. The safety guard has a plurality of pivoting plates or blades which expand to create a barrier preventing insertion of objects and body parts between the arms of the scissor lift. A method of preventing pinching at the joints connecting arms of a scissor lift is also disclosed.

15 Claims, 8 Drawing Sheets

SAFETY GUARD FOR SCISSOR LIFT

REFERENCE TO RELATED APPLICATION

This application is a formal version of the provisional application filed on Apr. 11, 1997 and assigned Ser. No. 60/043,662.

TECHNICAL FIELD

The present invention relates to safety guards for lift mechanisms. More particularly, the present invention relates to an expandable safety guard for preventing pinching between the arms of scissor lifts.

BACKGROUND

Scissor lifts are mechanisms used in commercial and industrial settings to safely and easily elevate a work platform to a desired height. Most scissor lifts include at least two sets of paired "arms". The arms are pivotably joined to each other at their ends and midpoints to create an extendible linkage. In order to extend the range of the scissor lift, multiple pairs of arms can be connected end-to-end. By expanding or contracting the distance between the ends of the lowest set of arms, the total height of the extendible linkage is increased or decreased.

A work platform is typically mounted on the uppermost pair of arms. The work platform and extendible linkage may vary in size and strength depending upon the foreseeable load bearing characteristics of the scissor lift. Frequently, scissor lifts can support more than one person and extend over thirty feet in height.

During the raising and lowering of a scissor lift, the pairs of joined arms comprising the extendible linkage pivot with respect to one another at numerous pivot points. These pivot points are located both where the ends of the arms join one another, as well as at the midpoints of the arms. Each of these pivot points are potential "pinch points" where the potential exists for pinching body parts or objects between two arms. Even a relatively simple scissor lift can have over a dozen pinch points.

During use, the operator of the scissor lift is typically positioned up on the work platform, and may not always take a careful visual inspection to assure that no one is in a dangerous position with respect to the lift arms. The operator may also find it difficult or even impossible to watch each one of these pinch points at the same time when lowering the scissor lift. When an operator is controlling the movement of the lift apparatus from on top of the platform, it can be very difficult to see over the edges sufficiently to view all pinch points and ascertain that nobody will be pinched. When an operator is controlling the movement of the lift apparatus from below, similar difficulties arise due to the large number of potential pinch points, as well as the possibility of a view obstructed by the lift arms as they are being lowered.

Severe injury may result to body parts at the pinch points during lowering of the scissor lift. For example, the operator, or an observer may have fingers, hands, or arms crushed or even severed. In the case of the most severe injuries, lifelong debilitation or even death may occur. In addition to the pain and suffering inflicted upon the injured person, tremendous costs can result from lost wages, rehabilitation, retraining, etc. The cumulative personal and economic costs associated with such injuries can be very high.

In addition to the potential for injury to operators and observers of the scissor lift, damage to the scissor lift itself or to objects positioned near the scissor lift is possible.

The hazards associated with using scissor lifts have been recognized by industry groups such as the Scaffold Industry Association, which has prepared standards for the design, manufacture, maintenance, and use of lift platforms. The Scaffold Industry Association has also welcomed proposals for improving safety standards for scissor lifts.

Many scissor lifts are currently in use, and the majority of these do not include safety guards. In order to improve the safety of such scissor lifts, a retrofitted guard must be installed on the scissor lift. In retrofitting these scissor lifts, the guard must be able to be installed on an existing scissor lift with a minimum of effort and expense. Also, the guard is preferably removable for maintenance on the lift apparatus or on the guard itself.

Accordingly, there is a need for a guard preventing pinching between the arms of a scissor lift. Even further, there is a need for a guard that can easily be installed on existing scissor lifts, as well as included with newly manufactured scissor lifts.

SUMMARY

In accordance with the present invention, an apparatus and method is provided for preventing pinching between the arms of a scissor lift. The apparatus includes a plurality of plates configured to mount to the scissor lift. A front plate, back plate, and at least one intermediate plate are included. The intermediate plate pivots between the front plate and back plate to create a barrier restricting insertion of objects and body parts between the arms of the scissor lift. A hole extends through the plates, and a mounting pin is positioned within the hole to provide an axis on which the plates pivot during the raising and lowering of the scissor lift. Mounting brackets are also disclosed, and secure the front plate to a first arm of the scissor lift and the back plate to a second arm of the scissor lift.

In some implementations of the present invention, a recess is positioned in the intermediate plate. A guide post positioned on the back plate engages the recess in the intermediate plate and assists in lifting the intermediate plate when the scissor lift is raised. In specific embodiments, the guide post includes a shaft and head secured to the end of the shaft. The head has a diameter greater than the diameter of the shaft and is configured to retain the guide post within the recess in the intermediate plate.

The present invention also provides a method for preventing pinching at the joint connecting two arms of a scissor lift. The method uses a pinch guard comprising a front plate, a back plate, and an intermediate plate. The front plate is configured and arranged to mount to a first arm of the scissor lift, and the back plate is configured to mount to a second arm of a scissor lift. The intermediate plate is configured to pivot between the front plate and back plate, forming a barrier restricting insertion of objects and body parts between the arms of the scissor lift. In certain implementations, the method further comprises providing a hole extending through the plates and providing a mounting pin on which the plates may pivot.

DETAILED DESCRIPTION

The present invention initially will be described in general terms. Various embodiments of the present invention will then be described in detail with reference to the drawings, wherein like numerals represent like parts and assemblies throughout the several views. References to the described embodiments does not limit the scope of the invention, which is limited only by the scope of the appended claims.

The present invention is directed generally to a device for preventing the pinching of hands, arms, feet, heads, and other body parts between the arms of a scissor lift. The device generally comprises a number of "plates" or "blades" positioned at the point where two arms of a scissor lift connect with one another. Upon raising of the scissor lift the arms extend and the plates slide relative to one another to create a guard or shield hindering the insertion of body parts and other objects into the space between the arms, particularly the space closest to the pinch point. The device may be installed on a new scissor lift during manufacture of the lift, or alternatively, may be installed on new or existing scissor lifts after manufacture.

The invention has many advantages. The risk of serious injury from the pinching or severing of body parts at the joints connecting two arms can be dramatically reduced. Scissor lifts may continue to be used for a wide variety of lifting requirements without hindering their operation. Another advantage of the present invention is ease of use. New scissor lifts may be manufactured with the safety guard pre-installed at the manufacturing facility, and existing scissor lifts may be retrofitted quickly and easily. Furthermore, the safety guard is easily maintained, and replacement parts easily installed when necessary. The inspection, maintenance, and repair of the scissor lift is also not impaired by the invention. As a result, the present invention has a great deal of versatility and can be used with almost any type of scissor lift that is currently manufactured.

Figure 1:
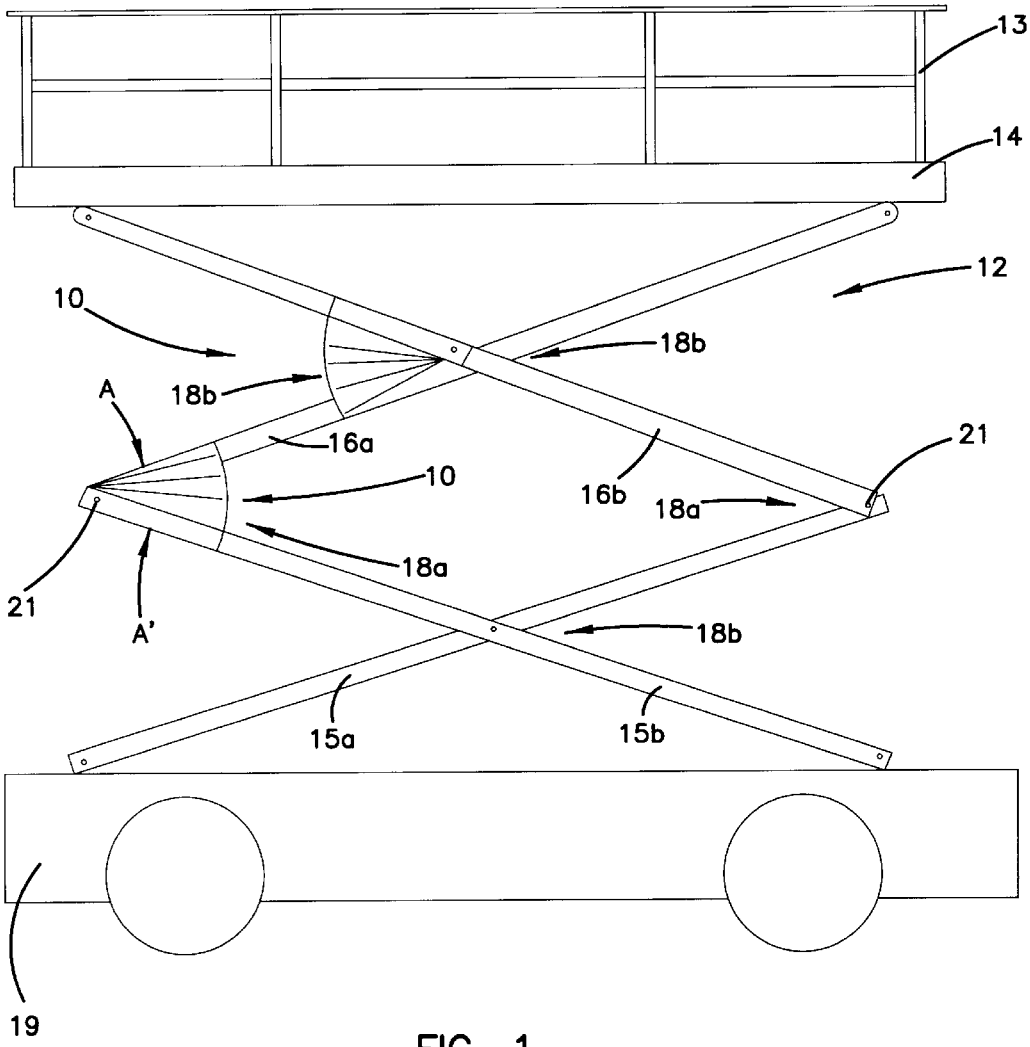
FIG. 1 is an elevated view of a scissor lift including safety guards constructed in accordance with the present invention, showing the safety guards extended.

Referring now to the figures, in FIG. 1, a scissor lift, generally shown as 12, contains two safety guards 10. The scissor lift 12 includes a base 19, arms 15*a*, 15*b*, 16*a*, and 16*b*, and a platform 14. Platform 14 is generally configured for providing a work surface for one or more workers. A handrail 13 is attached to and wraps around the platform 14. The handrail 13 provides protection against accidental falls of people or equipment from the platform 14.

The arms 15*a*, 15*b*, 16*a*, and 16*b* are joined to one another at a pivot points 18*a* and 18*b*. Pivot points 18*a* are formed at the ends of the arms, and form "external" pivot points. Pivot points 18*b* are formed at the point where two arms meet at their middles, and thus form "internal" pivot points. In FIG. 1, guards 10 are positioned for demonstration purposes at one pivot point 18*a* and one pivot point 18*b*. In practice, guards 10 are typically positioned at all pivot points, including both internal and external pivot points. The guards 10 depicted in FIG. 1 are shown in an extended mode, with the individual plates or blades 60 (FIGS. 2 and 3) pivoted apart.

Figure 2:
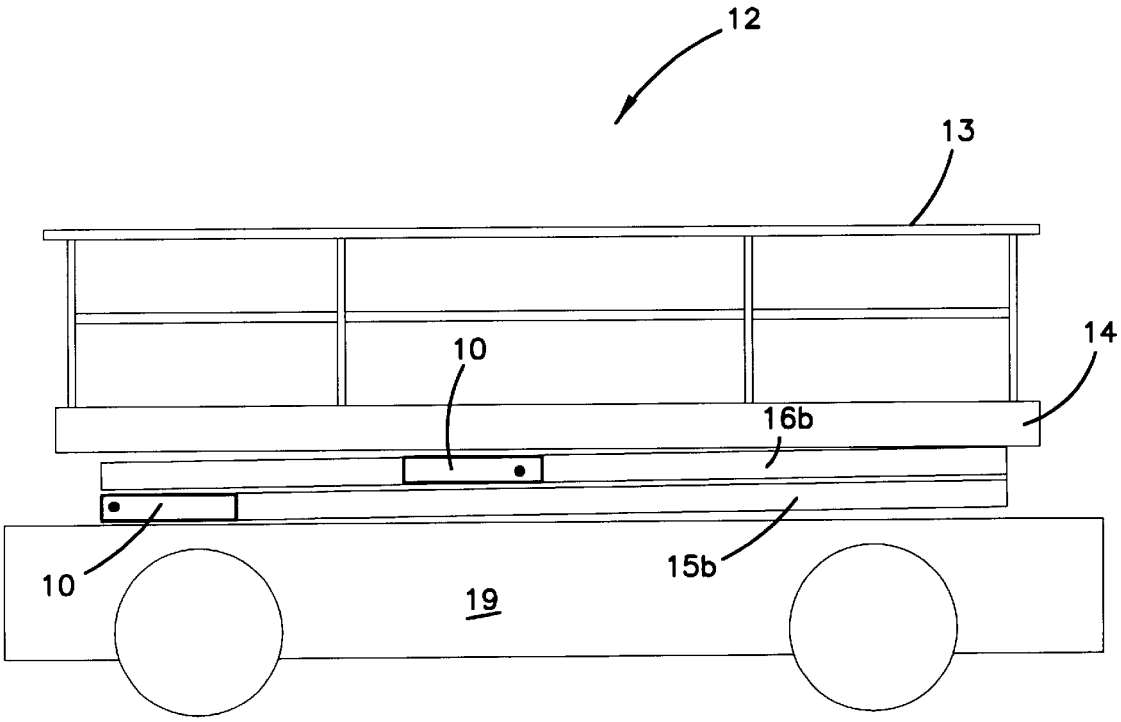
FIG. 2 is an elevated view of a scissor lift including safety guards constructed in accordance with the present invention, showing the safety guards contracted.

Referring now to FIG. 2, the scissor lift 12 is shown in a lowered position. The arms 15*b*, 16*b* are adjacent to one another, and the platform 14 and base 19 are also in close proximity to one another. The guards 10 are contracted, and the individual plates are aligned with one another. Yet other embodiments have only the front and back plates 20 and 40. Still other embodiments include only a single plate or other form of a barrier that expands when the scissors lift is raised in order to limit entry into the space 26.

Figure 3:
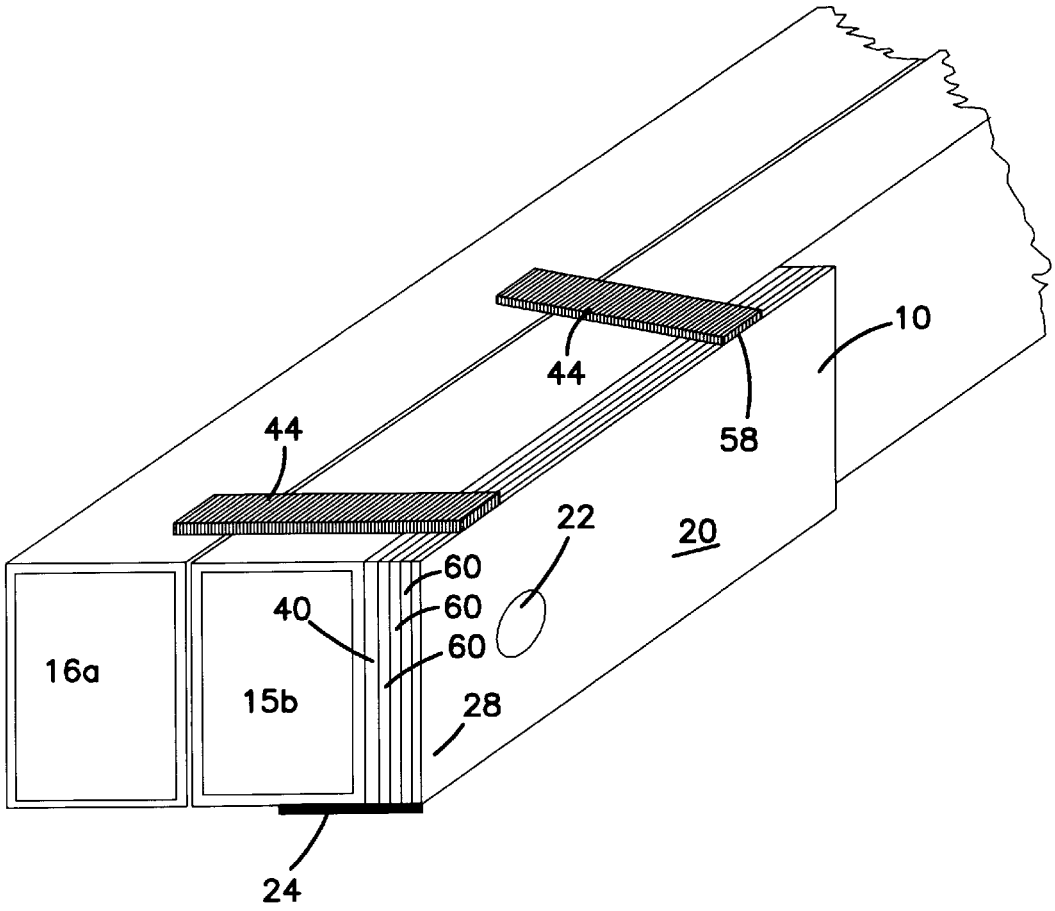
FIG. 3 is a perspective view of a safety guard constructed in accordance with the present invention, showing the guard secured to scissor lift arms.
Figure 4:
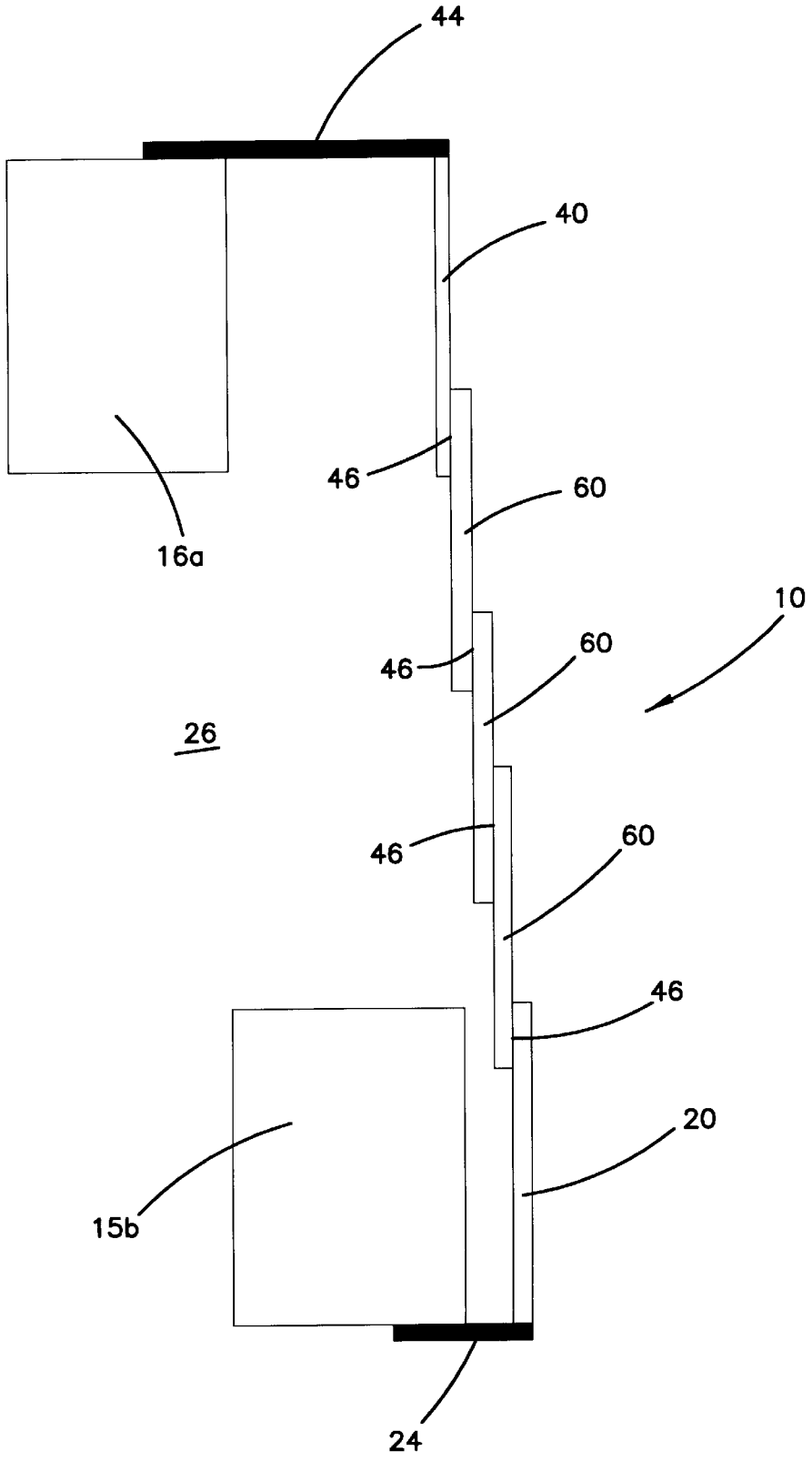
FIG. 4 is a cross-sectional view of a safety guard and two scissor lift arms taken along lines A–A' of FIG. 1, showing the safety guard extended.

Perspective views of the guard 10 are shown in FIGS. 3 and 4. In FIG. 3, the plurality of plates forming the guard are positioned on the front of arm 15*b* when the scissor lift is in a lowered position. In FIG. 4, the cross-sectional view shows arm 15*b* and arm 16*a* extended. The plates 20, 40, 60 are spread apart from one another to form a barrier limiting entry into the space 26 between the extended arms 15*b*, 16*a*. One front plate 20, one back plate 40, and multiple intermediate plates 60 are depicted. In certain embodiments, only one intermediate plate 60 is used, while in other embodiments a multitude of plates 60 are used. The plates overlap one another at area 46. The overlap area 46 increases as the scissor lift is lowered, and decreases as the scissor lift is raised.

Retainers 24, 44 secure the guard 10 to the arms 15*b*, 16*a* of the scissor lift. As depicted in FIGS. 3 and 4, in one implementation of the present invention, a first retainer 24 secures the front plate 20 to the front arm 15*b*, while a second retainer 44 secures the back plate 40 to the back arm 16*a*. Upon raising the scissor lift 12, the retainers 24 and 44 secure the guard 10 and allow it to pivot.

Figure 5A:
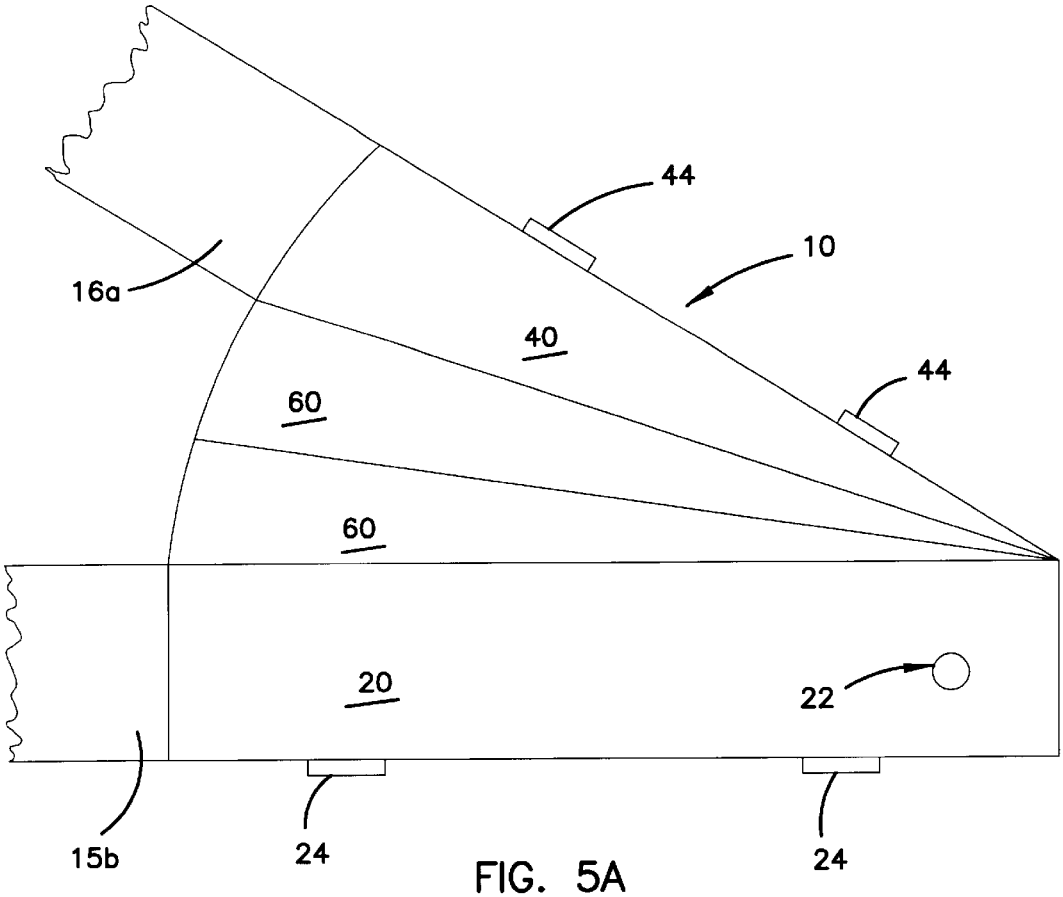
FIG. 5A is a partial elevational view of scissor lift arms and a safety guard constructed in accordance with the present invention, showing the guard extended.
Figure 5B:
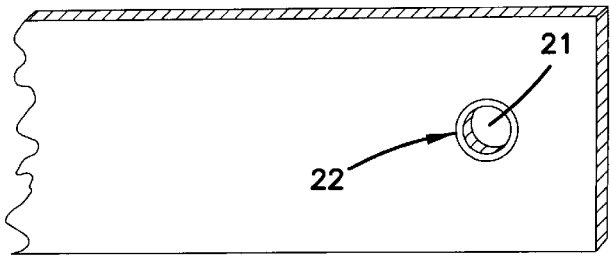
FIG. 5B is a view of a pin inserted within the safety guard, showing the pin with a hollow center.

As shown generally in FIG. 5A, the guard 10 pivots along pivot point 22. Pivot point 22 runs through each of the plates 20, 40, 60 which form the guard 10. Pivot point 22 aligns with the pivot point joining the two arms, for example 15*a* and 16*b*, of the scissor lift 12. A pin 21 is inserted into the pivot point 22 to form an axis of rotation around which the plates 20, 40, 60 rotate. In one implementation of the present invention, pin 21 is hollow and open ended, as shown in FIG. 5B, thereby allowing a person to inspect a pin holding the arms of the scissor lift together, as well as remove, lubricate, or otherwise maintain the pin extending through the arms of the scissor lift.

The plates 20, 40, 60 may be constructed of plastic, metal, or other material known to those of skill in the art. In one implementation, each plate is formed of a blow-molded plastic. In other implementations, the plates are formed of cast plastic or metal. In still other implementations, the plates are formed of sheet metal.

Figure 6A:
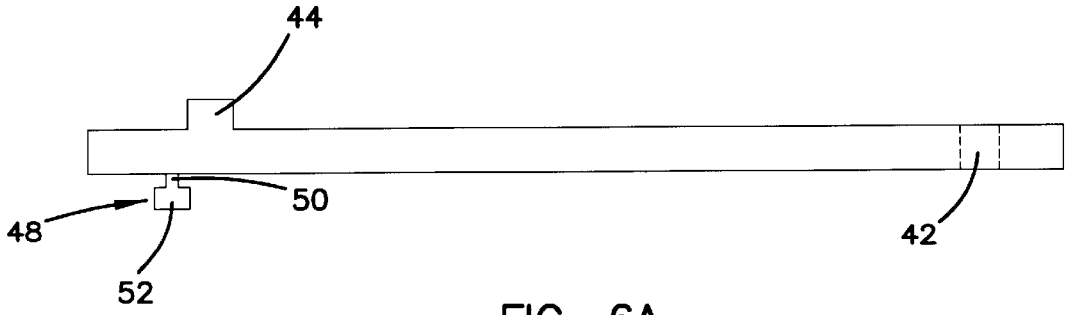
FIG. 6A is a top view of back plate constructed in accordance with the present invention.
Figure 6B:
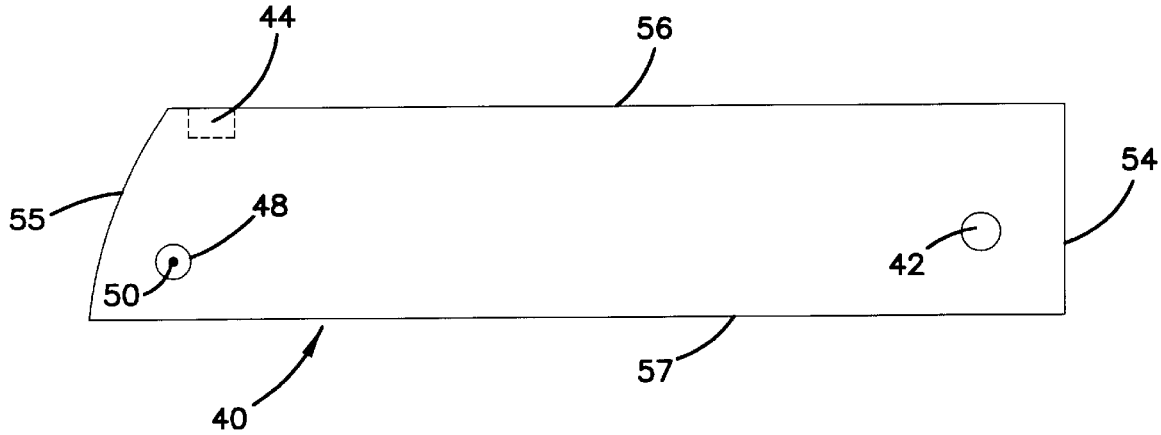
FIG. 6B is a front view of the plate shown in FIG. 6A.
Figure 6C:
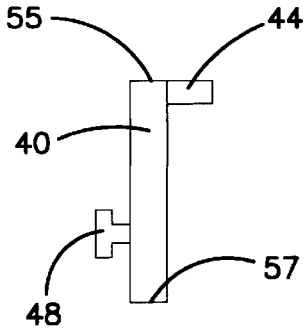
FIG. 6C is an end view of a plate shown in FIG. 6A.
Figure 7A:
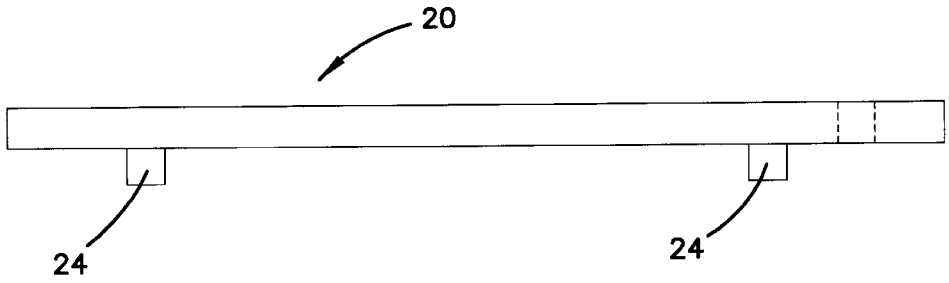
FIG. 7A is a top view of a front plate constructed in accordance with the present invention.
Figure 7B:
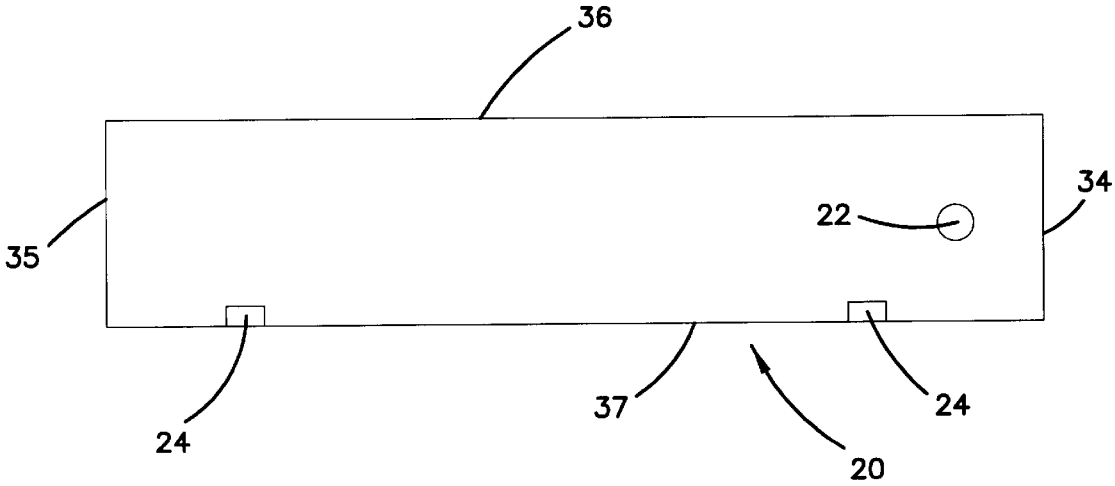
FIG. 7B is a front view of the plate shown in FIG. 6A.
Figure 7C:
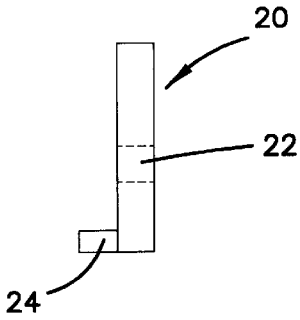
FIG. 7C is an end view of a plate shown in FIG. 7A.
Figure 8:
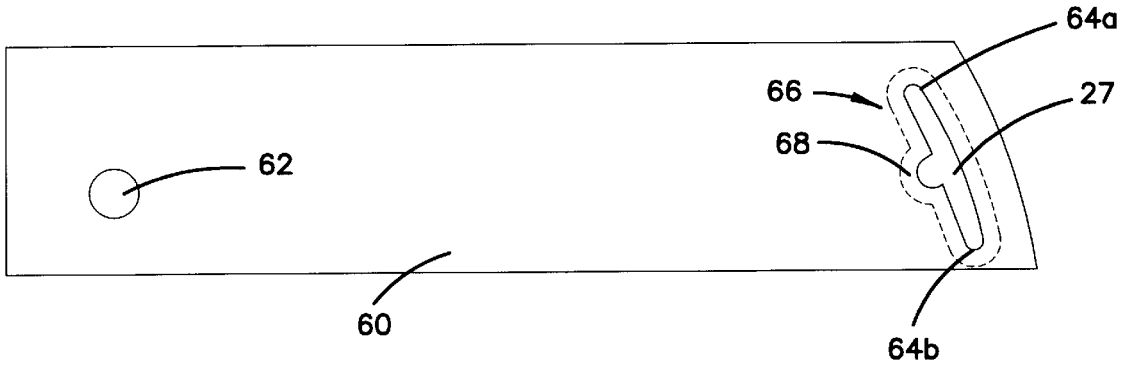
FIG. 8 is a back view of an intermediate plate constructed in accordance with the present invention.

As shown generally in FIGS. 6, 7, and 8, the plates 20, 40, 60 are constructed to facilitate the easy and efficient opening of the guard upon raising the scissor lift 12. FIGS. 6A, 6B, and 6C depict an embodiment of the back plate. The top view shown in FIG. 6A shows a retainer 44 on the back side of the plate, which is in contact with the arm of the scissor lift 12. A top edge 56, bottom edge 57, and side edges 54, 55 define the perimeter of the back plate depicted. Hole 42 permits the insertion of the pin 21 forming the axis of rotation upon which the plates of the guard 10 pivot.

In addition, a guide post 48 is shown. Guide post 48 includes a head 52 and a stem 50, and engages a recess 66 in the back side of intermediate plate 60, shown in FIG. 8. Upon raising of the scissor lift 12, back plate 40 and guide post 48 are lifted upward. Guide post 48 slides within recess 66 until the stem 50 of guide post 48 reaches the upper end 64*a* of recess 66. Upon reaching the upper end 64*a*, guide post 48 lifts intermediate plate 60. In alternative embodiments of the present invention, additional guide posts are installed on the front surface of the intermediate plates 60. The additional guideposts engage the recesses 66 of the intermediate plates in front of the guide post, thereby assisting in lifting of each intermediate plate as the scissor lift is raised.

FIGS. 7A, 7B, and 7C show front plate 20. The top view 7A, front view 7B, and end view 7C show retainers 24 for securing the front plate 20 to the lift arms. A top edge 36, bottom edge 37, and side edges 34, 35 define the perimeter of the front plate depicted. Hole 22 is configured for receiving pin 21. FIG. 8 shows intermediate plate 60.

In some implementations, the recess 66 is designed to both engage the stem 50 and head 52 of guide post 48 as well as retain the head 52. A first portion 67 of the recess 66 is wide enough for the stem 50 to slide within the recess 66, but too narrow for the head 52 to leave the recess 66. This configuration permits adjacent plates to be held against one another, thereby increasing the stability of the guard 10 and enhancing the protective features. In certain implementations, a portion of the first portion 67 is widened to create an opening 68 for insertion and removal of the head 52 into and out of the recess 66. Opening 68 allows the removal and replacement of individual plates 60 when desired, such as for repair, expansion, etc.

The retainers 24, 44 shown in FIGS. 6 and 7 are secured to the scissor lift in order to provide a solid attachment for the guard 10. The retainers 24, 44 are held to the arms by adhesive in one implementation of the present invention. In another implementation of the present invention, the retainers 24, 44 are secured to the arms by screws or bolts.

While the invention has been described in conjunction with a specific embodiment thereof, it is evident that different alternatives, modifications, and variations will be apparent to those skilled in the art in view of the foregoing description. Accordingly, the invention is not limited to these embodiments or the use of elements having specific configurations and shapes presented herein. Rather, the scope and spirit of the present invention is dictated by the following claims.

The claimed invention is:

1. A scissor lift having an expandable safety guard, the scissor lift comprising:

a scissor lift having a first arm pivotally connected to a second arm;

an expandable safety guard attached to the scissor lift between the first and second arm at the pivotally connection, the safety guard including:

a front plate mounted to the first arm of the scissor lift;

a back plate mounted to the second arm of the scissor lift; and at least one intermediate plate configured and arranged to pivot between the front plate pivotally connected to the front and back plate and the back plate to form a barrier restricting the insertion of objects and body parts between the arms of the scissor lift.

2. The expandable safety guard according to claim 1, further comprising:

a hole extending through the safety guard from a front surface to a back surface; and a mounting pin positioned within the hole extending through the safety guard, the mounting pin providing an axis on which the plates pivot.

3. The expandable safety guard according to claim 1, further comprising:

a recess in the intermediate plate; and a guide post on the back plate, the guide post configured and arranged to engage the recess in the intermediate plate and assist in lifting the intermediate plate when the scissor lift is raised.

4. The expandable safety guard according to claim 3, wherein the guide post further comprises:

a shaft; and a head secured to the end of the shaft, the head having a diameter greater than the diameter of the shaft and configured to retain the guide post within the recess.

5. The expandable safety guard according to claim 4, wherein the recess further comprises:

an inner portion comprising a groove configured to receive the head of the guide post; and an outer portion comprising a groove narrower than the outer portion, and retaining the head within the recess.

6. The expandable safety guard according to claim 1, further comprising a hole piercing each of the plates, the hole positioned so as to permit the inspection of a pin joining the first arm and second arm of the scissor lift.

7. The expandable safety guard according to claim 1, further comprising:

a first mounting bracket secured to the front plate, the first mounting bracket configured and arranged for connecting the front plate to a first arm; and a second mounting bracket secured to the back plate, the second mounting bracket configured and arranged for connecting the back plate to a second arm.

8. The expandable safety guard according to claim 1, wherein the safety guard comprises a plurality of intermediate plates.

9. The expandable safety guard according to claim 1, wherein each plate is at least 12 inches long.

10. A scissor lift having an expandable safety guard for preventing injuries associated with scissor lifts, the scissor lift having a first arm pivotally connected to a second arm comprising:

an expandable fan, the fan including a plurality of blades secured to each other at a pivot point; the expandable fan attached to the scissor lift between the first and second arm at the pivotal connection;

a first mounting surface securing the fan to the first arm of the scissors lift; and a second mounting surface securing the fan to the second arm of the scissors lift;

wherein the fan is configured and arranged to open and close during the raising and lowering of the scissor lift, the blades preventing the insertion of objects or body parts proximate a point where the first arm and second arm meet.

11. The scissor lift pinch guard according to claim 10, further comprising:

a hole extending through each blade from a front surface to a back surface; and a mounting pin, the mounting pin providing an axis on which the plates pivot.

12. The scissor lift pinch guard according to claim 10, further comprising:

a recess in a first blade, the recess configured and arranged to receive a post; and a guide post on a second blade, the guide post configured and arranged to engage the recess and assist in lifting the first blade when the scissor lift is raised.

13. The scissor lift pinch guard according to claim 12, wherein the guide post further comprises:

a shaft; and a head secured to the end of the shaft, the head having a diameter greater than the diameter of the shaft and configured to retain the guide post within the recess.

14. The scissor lift pinch guard according to claim 13, wherein the recess further comprises:

an inner portion comprising a groove configured to receive the head of the guide post; and an outer portion comprising a groove narrower than the outer portion, and retaining the head within the recess.

15. The scissor lift pinch guard according to claim 10, wherein the plurality of blades comprises at least 3 blades.

* * * * *